US011523482B2

(12) United States Patent
Qiu

(10) Patent No.: US 11,523,482 B2
(45) **Date of Patent: *Dec. 6, 2022**

(54) CONTROL DESIGN FOR PERCEPTUALLY UNIFORM COLOR TUNING

(71) Applicant: Lumileds LLC, San Jose, CA (US)

(72) Inventor: Yifeng Qiu, San Jose, CA (US)

(73) Assignee: Lumileds LLC, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/118,332

(22) Filed: Dec. 10, 2020

(65) Prior Publication Data

US 2021/0092811 A1 Mar. 25, 2021

Related U.S. Application Data

(63) Continuation of application No. 16/528,108, filed on Jul. 31, 2019, now Pat. No. 10,912,171.

(51) Int. Cl.
*H05B 45/20* (2020.01)

(52) U.S. Cl.
CPC ..... *H05B 45/20* (2020.01)

(58) Field of Classification Search
CPC ..... H05B 37/0272; H05B 33/0854; H05B 37/0227; H05B 33/0863; H05B 33/0872; H05B 37/0218; H05B 37/0236; H05B 37/0281; H05B 33/086; H05B 33/0869; H05B 33/0857
See application file for complete search history.

(56) References Cited

U.S. PATENT DOCUMENTS

| | | | | |
|---|---|---|---|---|
| 2010/0084995 | A1 | 4/2010 | Baaijens et al. | |
| 2014/0300283 | A1 | 10/2014 | Lee et al. | |
| 2018/0160491 | A1* | 6/2018 | Biery | H05B 47/19 |
| 2019/0254142 | A1 | 8/2019 | Petluri et al. | |
| 2019/0297704 | A1* | 9/2019 | van de Ven | F21V 29/74 |

OTHER PUBLICATIONS

"U.S. Appl. No. 16/528,108, Corrected Notice of Allowability dated Nov. 5, 2020", 2 pgs.
"U.S. Appl. No. 16/528,108, Final Office Action dated Jun. 12, 2020", 11 pgs.

(Continued)

*Primary Examiner* — Monica C King
(74) *Attorney, Agent, or Firm* — Schwegman Lundberg & Woessner, P.A.

(57) ABSTRACT

Various embodiments include apparatuses and methods control apparatus to color tune a light-emitting diode (LED) array. In one specific example, a control apparatus to color tune a light-emitting diode (LED) array for perceptually uniform color-tuning is disclosed. The apparatus includes a correlated color temperature (CCT)-control device that is adjustable by an end-user to a desired color temperature of the LED array and producing an output signal corresponding to the desired color temperature. A storage device is electrically coupled to the CCT-control device to correlate a mechanical movement range of the CCT-control device to provide substantially uniform increases in perceptual CCT values from the LED array based on a set of N predetermined values. Other apparatuses and methods are described.

23 Claims, 9 Drawing Sheets

(56) References Cited

OTHER PUBLICATIONS

"U.S. Appl. No. 16/528,108, Non Final Office Action dated Jan. 8, 2020", 10 pgs.
"U.S. Appl. No. 16/528,108, Notice of Allowance dated Sep. 15, 2020", 5 pgs.
"U.S. Appl. No. 16/528,108, Notice of Allowance dated Sep. 23, 2020", 5 pgs.
"U.S. Appl. No. 16/528,108, Response filed Apr. 8, 2020 to Non Final Office Action dated Jan. 8, 2020", 12 pgs.
"U.S. Appl. No. 16/528,108, Response filed Aug. 12, 2020 to Final Office Action dated Jun. 12, 2020", 13 pgs.
"European Application Serial No. 19207130.6, Search Report dated Mar. 30, 2020", 11 pgs.
"International Application Serial No. PCT/US2020/043916, International Search Report dated Sep. 29, 2020", 4 pgs.
"International Application Serial No. PCT/US2020/043916, Written Opinion dated Sep. 29, 2020", 8 pgs.
U.S. Appl. No. 16/528,108, filed Jul. 31, 2019, Control Design for Perceptually Uniform Color Tuning.
"Korean Application Serial No. 10-2022-7006112, Notice of Preliminary Reasons for Refusal dated Jul. 21, 2022", (w/ English Translation), 5 pgs.
"European Application Serial No. 20757439.3, Response to Communication pursuant to Rules 161(1) and 162 EPC filed Sep. 8, 2022", 76 pgs.
"Korean Application Serial No. 10-2022-7006112, Response filed Sep. 19, 22 to Notice of Preliminary Reasons for Refusal dated Jul. 21, 2022", (w/ English Translation of Claims), 14 pgs.

* cited by examiner

CONTROL DESIGN FOR PERCEPTUALLY UNIFORM COLOR TUNING

CLAIM OF PRIORITY

This application claims the benefit of priority to U.S. application Ser. No. 16/528,108, filed Jul. 31, 2019, which is incorporated herein by reference in its entirety.

TECHNICAL FIELD

The subject matter disclosed herein relates to color tuning of one or more light-emitting diodes (LEDs) or LED arrays that comprise a lamp operating substantially in the visible portion of the electromagnetic spectrum. More specifically, the disclosed subject matter relates to a technique to enable, for example, a user-control design method and apparatus to create a perceptually uniform color-tuning experience of the one or more LEDs or LED arrays.

BACKGROUND

Light-emitting diodes (LEDs) are commonly used in various lighting operations. The color appearance of an object is determined, in part, by the spectral power density (SPD) of light illuminating the object. For humans viewing an object, the SPD is the relative intensity for various wavelengths within the visible light spectrum. However, other factors can also affect color appearance. Also, both a correlated color temperature (CCT) of the LED, and a distance of the temperature of the LED on the CCT from a black-body line (BBL, also known as a black-body locus or a Planckian locus), can affect a human's perception of an object.

There are presently two major technologies for color tuning (e.g., white tuning) of LEDs. A first technology is based on white LEDs of two or more CCTs. The second technology is based on a combination of Red/Green/Blue/Amber colors. The first technology simply does not have a capability to tune LEDs in the $D_{uv}$ direction. In the second technology, the color tuning capability is seldom offered as an available function.

The information described in this section is provided to offer the skilled artisan a context for the following disclosed subject matter and should not be considered as admitted prior art.

DETAILED DESCRIPTION

Figure 1:
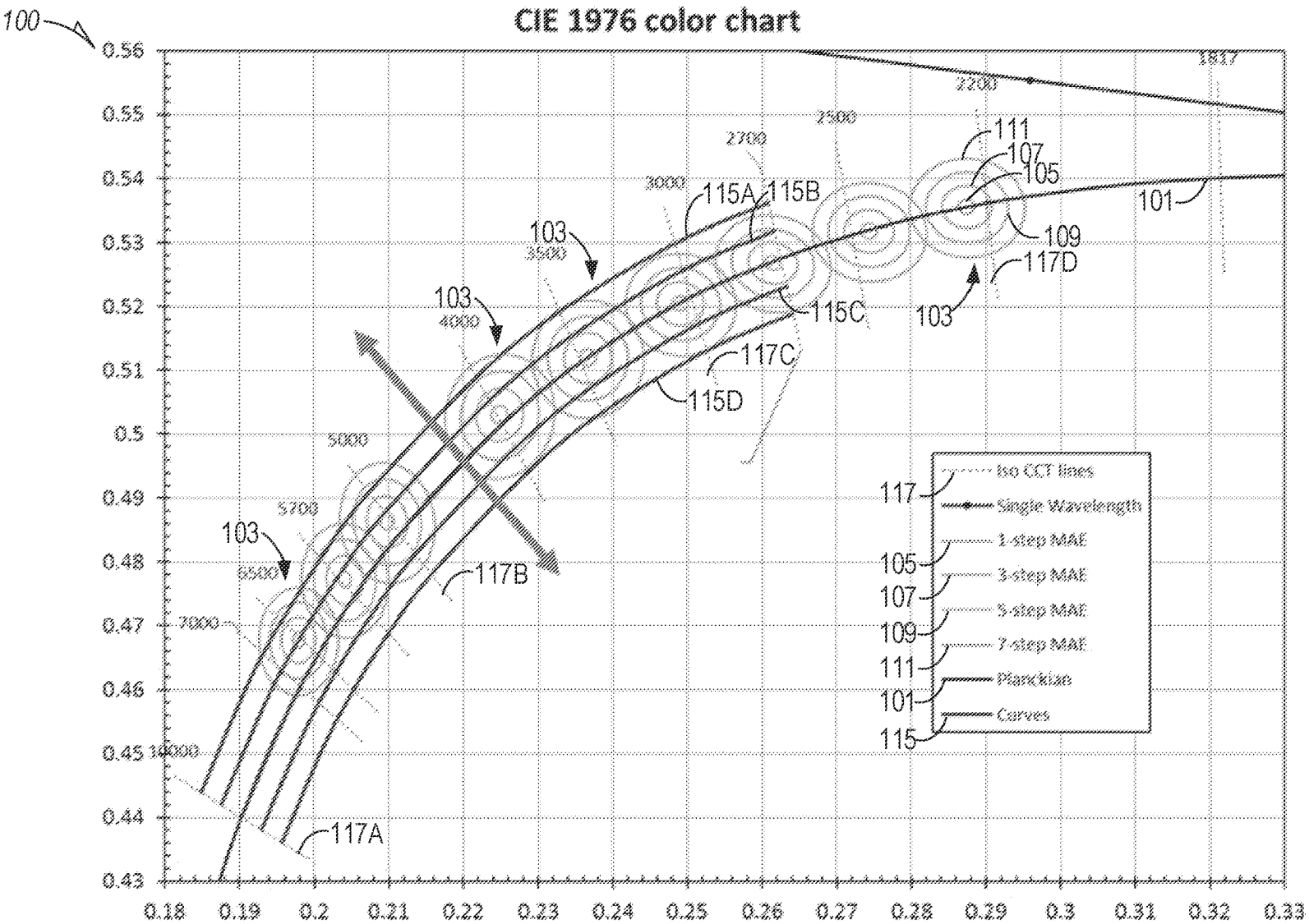
FIG. 1 shows a portion of an International Commission on Illumination (CIE) color chart, including a black body line (BBL)

The disclosed subject matter will now be described in detail with reference to a few general and specific embodiments as illustrated in various ones of the accompanying drawings. In the following description, numerous specific details are set forth in order to provide a thorough understanding of the disclosed subject matter. It will be apparent, however, to one skilled in the art, that the disclosed subject matter may be practiced without some or all of these specific details. In other instances, well-known process steps or structures have not been described in detail so as not to obscure the disclosed subject matter.

Examples of different light illumination systems and/or light-emitting diode (LED) implementations and a means to control those implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer generally to like elements throughout.

Further, it will be understood that, although the terms first, second, third, etc. may be used herein to describe various elements. However, these elements should not be limited by these terms. These terms may be used to distinguish one element from another. For example, a first element may be termed a second element and a second element may be termed a first element without departing from the scope of the disclosed subject matter. As used herein, the term "and/or" may include any and all combinations of one or more of the associated listed items.

It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below," "above," "upper," "lower," "horizontal," or "vertical" may be used herein to describe a relationship of one element, zone, or region relative to another element, zone, or region as illustrated in the figures. A person of ordinary skill in the art will understand that these terms are intended to encompass different orientations of the device in addition to an orientation depicted in the figures. Further, whether the LEDs, LED arrays, electrical components and/or electronic components are housed on one, two, or more electronics boards, or in one or multiple physical locations may also depend on design constraints and/or a specific application.

Semiconductor-based light-emitting devices or optical power-emitting-devices, such as devices that emit ultraviolet (UV) or infrared (IR) optical power, are among the most efficient light sources currently available. These devices may include light-emitting diodes, resonant-cavity light emitting diodes, vertical-cavity laser diodes, edge-emitting lasers, or the like (simply referred to herein as LEDs). Due to their compact size and low power requirements, LEDs may be attractive candidates for many different applications. For example, they may be used as light sources (e.g., flash lights and camera flashes) for hand-held battery-powered devices, such as cameras and cellular phones. LEDs may also be used, for example, for automotive lighting, heads-up display (HUD) lighting, horticultural lighting, street lighting, a torch for video, general illumination (e.g., home, shop, office and studio lighting, theater/stage lighting, and architectural lighting), augmented reality (AR) lighting, virtual reality (VR) lighting, as back lights for displays, and IR spectroscopy. A single LED may provide light that is less bright than an incandescent light source, and, therefore, multi-junction devices or arrays of LEDs (such as monolithic LED arrays, micro LED arrays, etc.) may be used for applications where enhanced brightness is desired or required.

In various environments where LED-based lamps (or related illumination devices) are used to illuminate objects as well as for general lighting, it may be desirable to control aspects of the color temperature of the LED-based lamps (or a single LED-based lamp) in addition to a relative brightness (e.g., luminous flux) of the lamps. Such environments may include, for example, retail locations as well as hospitality locations such as restaurants and the like. In addition to the CCT, another lamp metric is the color-rendering index (CRI) of the lamp. The CRI is defined by the International Commission on Illumination (CIE) and provides a quantitative measure of an ability of any light source (including LEDs) to accurately represent colors in various objects in comparison with an ideal, or natural-light source. The highest possible CRI value is 100. Another quantitative lamp metric is $D_{uv}$. The $D_{uv}$ is a metric defined in, for example, CIE 1960, to represent the distance of a color point to the BBL. It is a positive value if the color point is above the BBL and a negative value if the color point is below the BBL. Color points above the BBL appear greenish in color and those below the BBL appear pinkish in color. The disclosed subject matter provides an apparatus to control a color temperature (CCT and $D_{uv}$) in a smooth and visually pleasant, tuning experience. As described herein, the color temperature is related to both CCT and $D_{uv}$ in color-tuning applications.

As is known in the relevant art, the forward voltage of direct color LEDs decreases with increasing dominant wavelength. These LEDS can be driven with, for example, multichannel DC-to-DC converters. Advanced phosphor-converted color LEDs, targeting high efficacy and CRI, have been created providing for new possibilities for correlated color temperature (CCT) tuning applications. Some of the advanced color LEDs have desaturated color points and can be mixed to achieve white colors with 90+CRI over a wide CCT range. Other LEDs having 80+CRI implementations, or even 70+CRI implementations (or even lower CRI values), may also be used with the disclosed subject matter. These possibilities use LED circuits that realize, and increase or maximize, this potential. At the same time, the control devices described herein are compatible with single-channel constant-current drivers to facilitate market adoption.

An advantage of the disclosed subject matter over the prior art is that a desaturated Red-Green-Blue (RGB) LED approach, described in detail, below, can create tunable light on and off the BBL, as well as on the BBL, for example, on an isothermal CCT line (as described below) while maintaining a high CRI. Various other prior art systems, in comparison, utilize a CCT approach where tunable color-points fall on a straight line between two primary colors of LEDs (e.g., R-G, R-B, or G-B).

Overall, color tuning is an integral part of human-centric lighting. Advanced LED-based systems, such as the desaturated RGB LED approach and related control technologies, offer lighting specifiers and end-users new possibilities in lighting control. In addition to CCT tuning over a wide range, the user will be able to change the tint of the white light along an iso-CCT line as the end user finds pleasing. For example, the Lumileds® proprietary Luxeon® Fusion system, with its wide tuning range on a single platform, is an ideal candidate for various types of color-tunable applications (the Lumileds® Luxeon® Fusion system is manufactured by Lumileds LLC, 370 West Trimble Road, San Jose, Calif. 95131, USA). One aspect of human-centric lighting is an ability to change the correlated color temperature and light intensity at the same time. The disclosed subject matter is directed to a user-control design paradigm that creates a perceptually uniform, color-tuning experience.

With reference now to FIG. 1, a portion of an International Commission on Illumination (CIE) color chart 100, including a black body line (BBL) 101 (also referred to as a Planckian locus) that forms a basis for understanding various embodiments of the subject matter disclosed herein is shown. The BBL 101 shows the chromaticity coordinates for blackbody radiators of varying temperatures. It is generally agreed that, in most illumination situations, light sources should have chromaticity coordinates that lie on or near the BBL 101. Various mathematical procedures known in the art are used to determine the "closest" blackbody radiator. As noted above, this common lamp specification parameter is called the correlated color temperature (CCT). A useful and complementary way to further describe the chromaticity is provided by the $D_{uv}$ value, which is an indication of the degree to which a lamp's chromaticity coordinate lies above the BBL 101 (a positive $D_{uv}$ value) or below the BBL 101 (a negative $D_{uv}$ value).

The portion of the color chart is shown to include a number of isothermal lines 117. Even though each of these lines is not on the BBL 101, any color point on the isothermal line 117 has a constant CCT. For example, a first isothermal line 117A has a CCT of 10,000 K, a second isothermal line 117B has a CCT of 5,000 K, a third isothermal line 117C has a CCT of 3,000 K, and a fourth isothermal line 117D has a CCT of 2,200 K.

With continuing reference to FIG. 1, the CIE color chart 100 also shows a number of ellipses that represent a Macadam Ellipse (MAE) 103, which is centered on the BBL 101 and extends one step 105, three steps 107, five steps 109, or seven steps 111 in distance from the BBL 101. The MAE is based on psychometric studies and defines a region on the CIE chromaticity diagram that contains all colors which are indistinguishable, to a typical observer, from a color at the center of the ellipse. Therefore, each of the MAE steps 105 to 111 (one step to seven steps) are seen to a typical observer as being substantially the same color as a color at the center of a respective one of the MAEs 103. A series of curves, 115A, 115B, 115C, and 115D, represent substantially equal distances from the BBL 101 and are related to DA values of, for example, +0.006, +0.003, 0, −0.003 and −0.006, respectively.

Figure 2A:
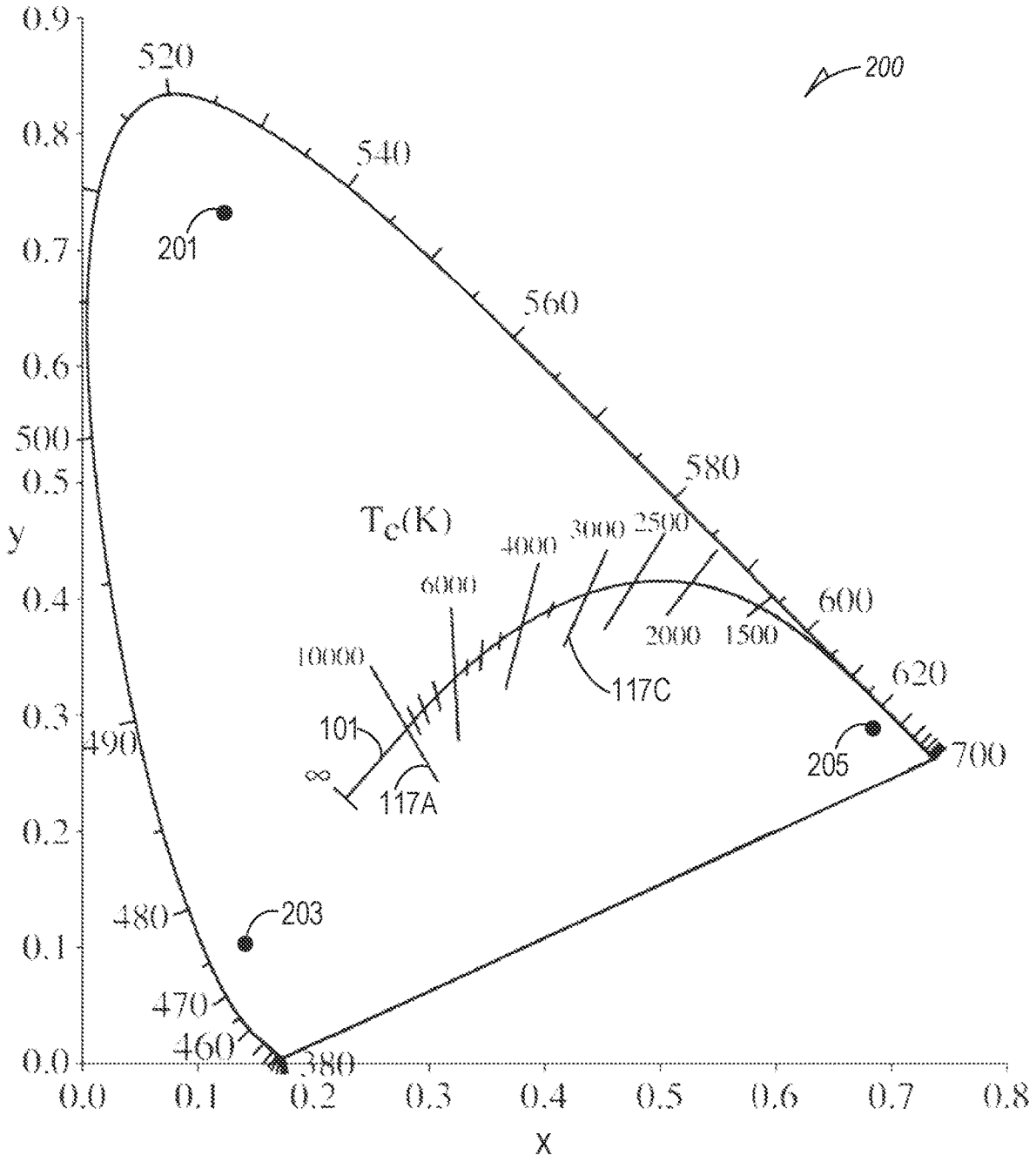
FIG. 2A shows a chromaticity diagram with approximate chromaticity coordinates of colors for typical red (R), green (G), and blue (B) LEDs, on the diagram, and including a BBL.

Referring now to FIG. 2A, and with continuing reference to FIG. 1, FIG. 2A shows a chromaticity diagram 200 with approximate chromaticity coordinates of colors for typical coordinate values (as noted on the x-y scale of the chromaticity diagram 200) for a red (R) LED at coordinate 205, a green (G) LED at coordinate 201, and a blue (B) LED at coordinate 203. FIG. 2A shows an example of the chromaticity diagram 200 for defining the wavelength spectrum of a visible light source, in accordance with some embodiments. The chromaticity diagram 200 of FIG. 2A is only one way of defining a wavelength spectrum of a visible light source; other suitable definitions are known in the art and can also be used with the various embodiments of the disclosed subject matter described herein.

A convenient way to specify a portion of the chromaticity diagram 200 is through a collection of equations in the x-y plane, where each equation has a locus of solutions that defines a line on the chromaticity diagram 200. The lines may intersect to specify a particular area, as described below in more detail with reference to FIG. 2B. As an alternative definition, the white light source can emit light that corresponds to light from a blackbody source operating at a given color temperature.

The chromaticity diagram 200 also shows the BBL 101 as described above with reference to FIG. 1. Each of the three LED coordinate locations 201, 203, 205 are the CCT coordinates for "fully-saturated" LEDs of the respective colors green, blue, and red. However, if a "white light" is created by combining certain proportions of the R, G, and B LEDs, the CRI of such a combination would be extremely low. Typically, in the environments described above, such as retail or hospitality settings, a CRI of about 90 or higher is desirable.

Figure 2B:
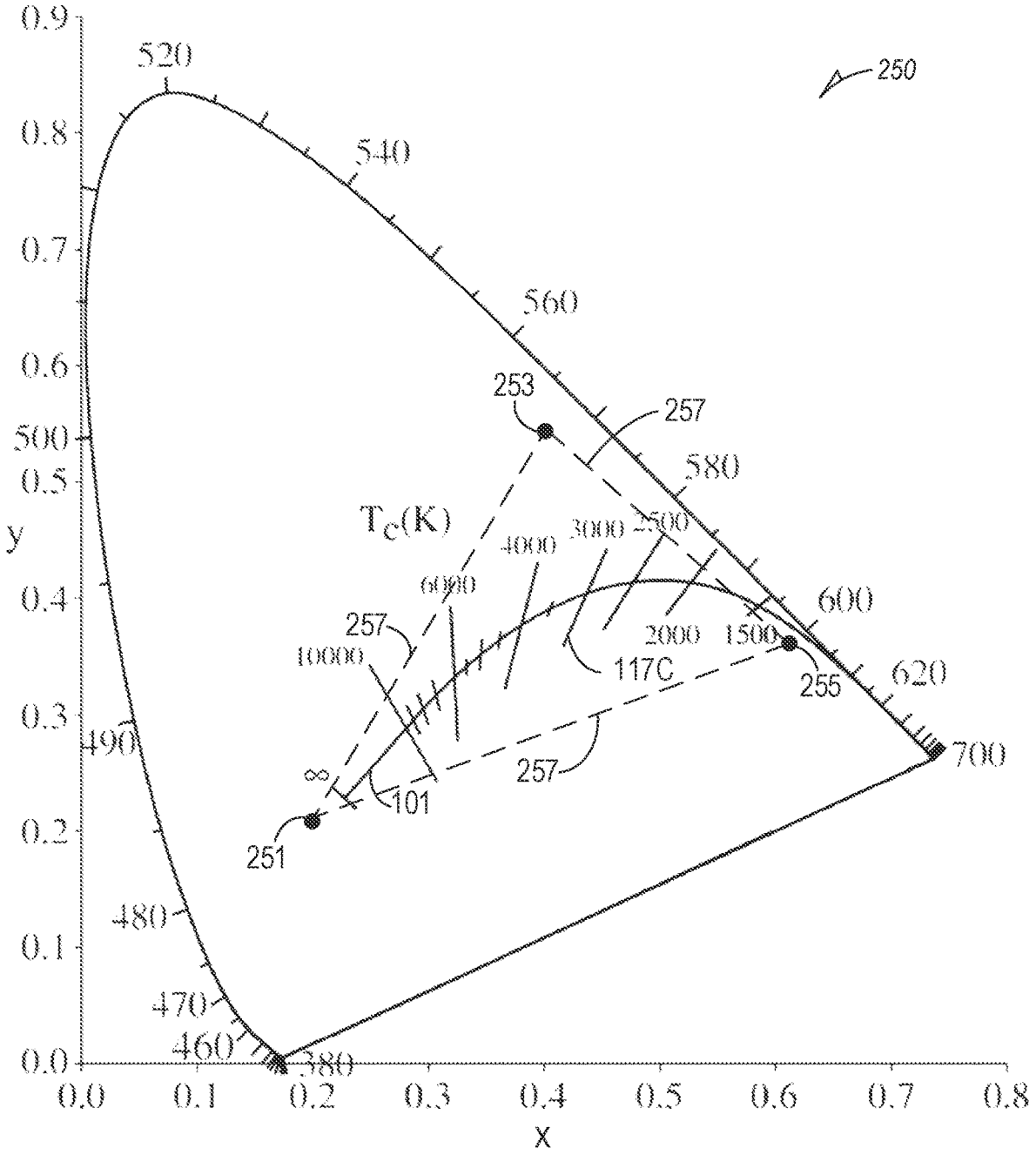
FIG. 2B shows a revised version of the chromaticity diagram of FIG. 2A, with approximate chromaticity coordinates for desaturated R, G, and B LEDs in proximity to the BBL, the desaturated R, G, and B LEDs having a color-rendering index (CRI) of approximately 90+ and within a defined color temperature range, in accordance with various embodiments of the disclosed subject matter.

FIG. 2B shows a revised version of the chromaticity diagram 200 of FIG. 2A, with approximate chromaticity coordinates for desaturated R, G, and B LEDs in proximity to the BBL, the desaturated R, G, and B LEDs having a color-rendering index (CRI) of approximately 90+ and within a defined color temperature range, in accordance with various embodiments of the disclosed subject matter.

However, the chromaticity diagram 250 of FIG. 2B shows approximate chromaticity coordinates for desaturated (pastel) R, G, and B LEDs in proximity to the BBL 101. Coordinate values (as noted on the x-y scale of the chromaticity diagram 250) are shown for a desaturated red (R) LED at coordinate 255, a desaturated green (G) LED at coordinate 253, and a desaturated blue (B) LED at coordinate 251. In various embodiments, a color temperature range of the desaturated R, G, and B LEDs may be in a range from about 1800 K to about 2500 K. In other embodiments, the desaturated R G, and B LEDs may be in a color temperature range of, for example, about 2700 K to about 6500 K. In still other embodiments, the desaturated R, G, and B LEDs may be in a color temperature range of about 1800 K to about 7500 K. In still other embodiments, the desaturated R, G, and B LEDs may be selected to be in a wide range of color temperatures. As noted above, the color rendering index (CRI) of a light source does not indicate the apparent color of the light source; that information is given by the correlated color temperature (CCT). The CRI is therefore a quantitative measure of the ability of a light source to reveal the colors of various objects faithfully in comparison with an ideal or natural-light source.

In a specific exemplary embodiment, a triangle 257 formed between each of the coordinate values for the desaturated R, G, and B LEDs is also shown. The desaturated R, G, and B LEDs are formed (e.g., by a mixture of phosphors and/or a mixture of materials to form the LEDs as is known in the art) to have coordinate values in proximity to the BBL 101. Consequently, the coordinate locations of the respective desaturated R, G, and B LEDs, and as outlined by the triangle 257, has a CRI have approximately 90 or greater and an approximate tunable color-temperature-range of, for example, about 2700 K to about 6500 K. Therefore, the selection of a correlated color temperature (CCT) may be selected in the color-tuning application described herein such that all combinations of CCT selected all result in the lamp having a CRI of 90 or greater. Each of the desaturated R, G, and B LEDs may comprise a single LED or an array (or group) of LEDs, with each LED within the array or group having a desaturated color the same as or similar to the other LEDs within the array or group. A combination of the one or more desaturated R, G, and B LEDs comprises a lamp.

Figure 2C:
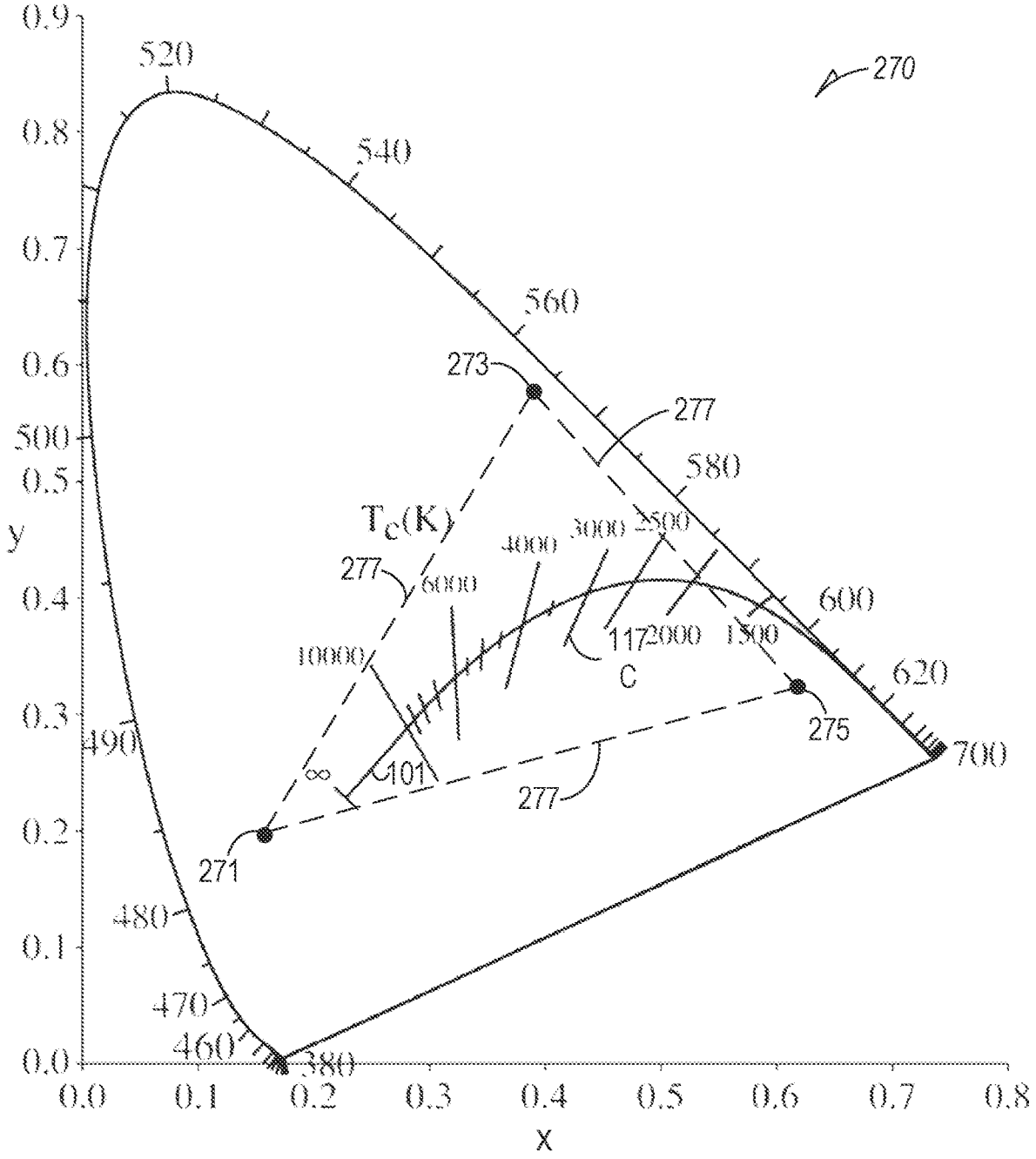
FIG. 2C shows a revised version of the chromaticity diagram of FIG. 2A, with approximate chromaticity coordinates for desaturated R, G, and B LEDs in proximity to the BBL, the desaturated R, G, and B LEDs having a color-rendering index (CRI) of approximately 80+ and within a defined color temperature range that is broader than the desaturated R, G, and B LEDs of FIG. 2B, in accordance with various embodiments of the disclosed subject matter.

FIG. 2C shows a revised version of the chromaticity diagram 200 of FIG. 2A, with approximate chromaticity coordinates for desaturated R, G, and B LEDs in proximity to the BBL, the desaturated R, G, and B LEDs having a color-rendering index (CRI) of approximately 80+ and within a defined color temperature range that is broader than the desaturated R, G, and B LEDs of FIG. 2B, in accordance with various embodiments of the disclosed subject matter.

However, the chromaticity diagram 270 of FIG. 2C shows approximate chromaticity coordinates for desaturated R, G, and B LEDs that are arranged farther from the BBL 101 than the desaturated R, G, and B LEDs of FIG. 2B. Coordinate values (as noted on the x-y scale of the chromaticity diagram 270) are shown for a desaturated red (R) LED at coordinate 275, a desaturated green (G) LED at coordinate 273, and a desaturated blue (B) LED at coordinate 271. In various embodiments, a color temperature range of the desaturated R, G, and B LEDs may be in a range from about 1800 K to about 2500 K. In other embodiments, the desaturated R, G, and B LEDs may be in a color temperature range of about 2700 K to about 6500 K. In still other embodiments, the desaturated R, G, and B LEDs may be in a color temperature range of about 1800 K to about 7500 K.

In a specific exemplary embodiment, a triangle 277 formed between each of the coordinate values for the desaturated R, G, and B LEDs is also shown. The desaturated R, G, and B LEDs are formed (e.g., by a mixture of phosphors and/or a mixture of materials to form the LEDs as is known in the art) to have coordinate values in proximity to the BBL 101. Consequently, the coordinate locations of the respective desaturated R, G, and B LEDs, and as outlined by the triangle 277, has a CRI have approximately 80 or greater and an approximate tunable color-temperature-range of, for example, about 1800 K to about 7500 K. Since the color temperature range is greater than the range shown in FIG. 2B, the CRI is commensurately decreased to about 80 or greater. However, a person of ordinary skill in the art will recognize that the desaturated R, G, and B LEDs may be produced to have individual color temperatures anywhere within the chromaticity diagram. Therefore, the selection of a correlated color temperature (CCT) may be selected in the color-tuning application described herein such that all combinations of CCT selected all result in the lamp having a CRI of 80 or greater. Each of the desaturated R, G, and B LEDs may comprise a single LED or an array (or group) of LEDs, with each LED within the array or group having a desaturated color the same as or similar to the other LEDs within the array or group. A combination of the one or more desaturated R, G, and B LEDs comprises a lamp.

Figure 3:
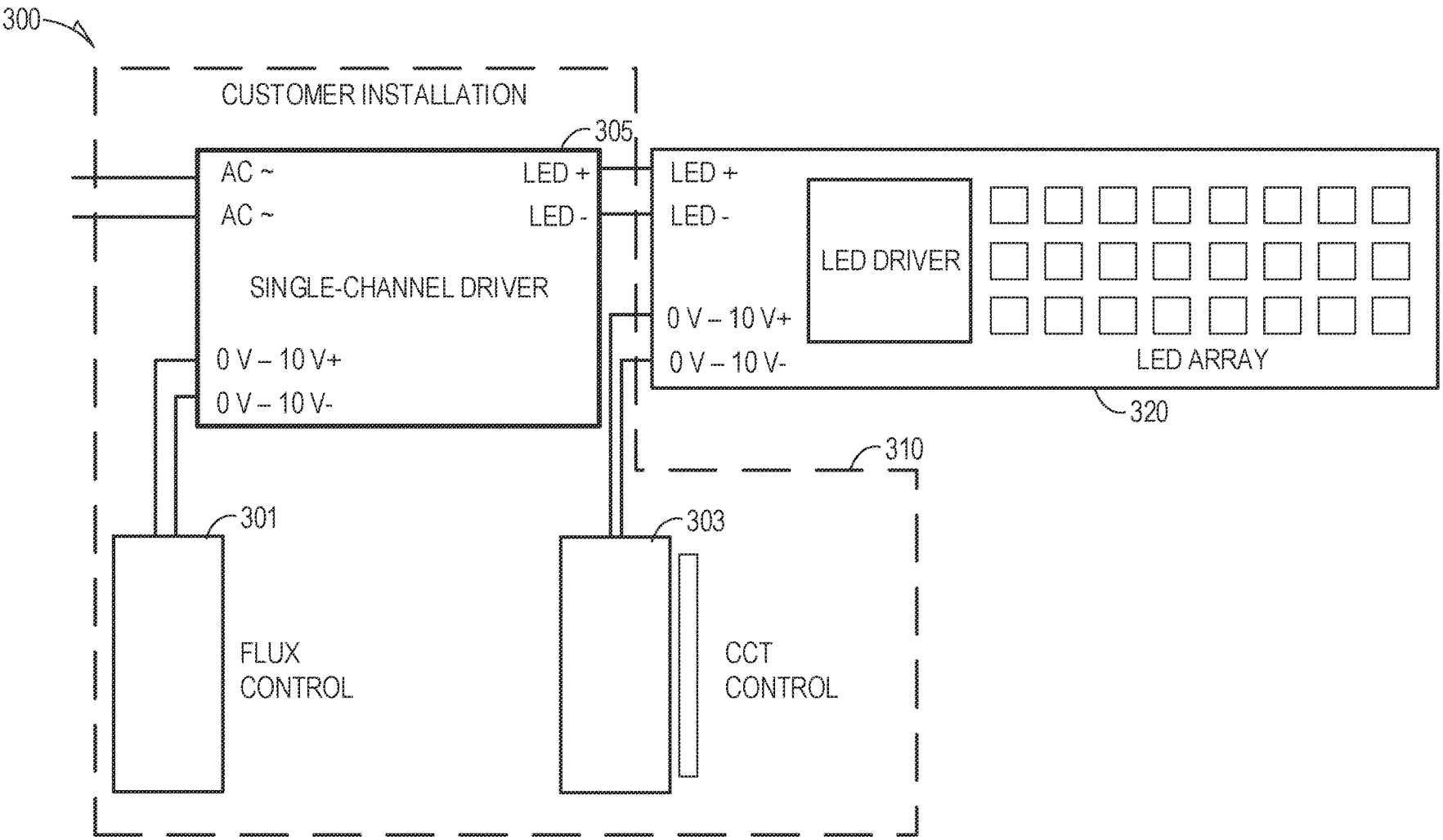
FIG. 3 (PRIOR ART)
FIG. 3 shows a color-tuning device of the prior art requiring a hard-wired flux control-device and a separate, hard-wired CCT control-device.

FIG. 3 shows a color-tuning device 300 of the prior art using a hard-wired flux-control device 301 and a separate, hard-wired CCT-control device 303. The flux-control device 301 is coupled to a single-channel driver circuit 305 and the CCT-control device is coupled to a combination LED-driving circuit/LED array 320. The combination LED-driving circuit/LED array 320 may be a current-driver circuit, a PWM driver circuit, or a hybrid current-driver/PWM-driver circuit. Each of the flux-control device 301, the CCT-control device 303, and the single-channel driver circuit 305 is located in a customer facility 310 and all devices generally must be installed with applicable national and local rules governing high-voltage circuits. The combination LED-driving circuit/LED array 320 is generally located remotely (e.g., a few meters to dozens of meters or more) from the customer facility 310. Consequently, both the initial purchase price and the installation price may be significant.

Consequently, in a conventional color-tunable system which operates off a single-channel constant-current driver, two control inputs are usually required, one for flux control (e.g., luminous flux or dimming) and the other for color tuning. The control inputs can be realized by, for example, electrical-mechanical devices, such as linear or rotary sliders, DIP switches, or a standard 0 V to 10V dimmer.

Figure 4:
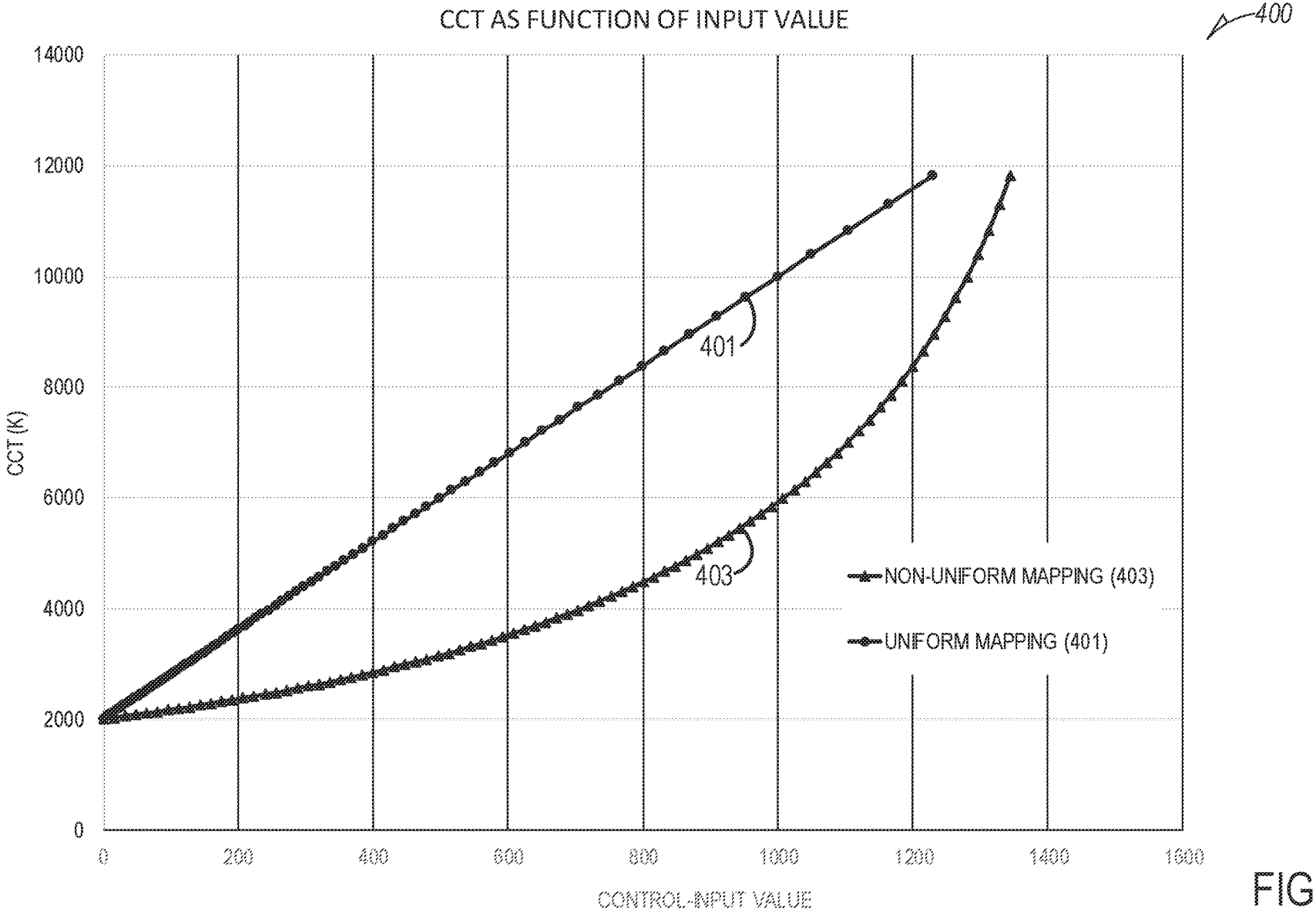
FIG. 4 is an exemplary embodiment of a graph that shows a CCT value as a function of a control input value and illustrates the difference between two user-control designs in accordance with various embodiments of the disclosed subject matter.

FIG. 4 is an exemplary embodiment of a graph 400 that shows a CCT value as a function of a control input value and illustrates the difference between two user-control designs in accordance with various embodiments of the disclosed subject matter. Results of the two user-control designs are shown as two graphical curves. The user-control device used to adjust the CCT value may the same as or similar to the CCT-control device 303 of FIG. 3, with an appropriate modification for the second user-control design as described below.

As is known to a person of ordinary skill in the art, the CCT is often used to represent chromaticity of white light sources. However, as described above, chromaticity is a two-dimensional value, and another dimension, the distance from the BBL, is often missing. $D_{uv}$ has been defined in the American National Standards Institute (ANSI) standard. Therefore, the two numbers of chromaticity coordinates (x, y) or (u', v') do not carry color information intuitively. The CCT and $D_{uv}$, do carry complete color information.

Further, a unit step in CCT values does not result in a uniform perception in color. This is corroborated by Table I, below, excerpted from ANSI C78.377 (2015). The tolerance in CCT is progressively larger with higher values of CCT. Consequently, if a user control representing CCT values is mapped linearly to CCT values, most visible changes happen during the beginning of a CCT-control device range (e.g., at the beginning of a slider range) and are therefore not linear as expected.

TABLE I

| Nominal CCT (K) | Target CCT and Tolerance (K) | Target $D_{uv}$ | $D_{uv}$ Tolerance Range |
|---|---|---|---|
| 2200 | 2238 ± 102 | 0.0000 | $T_x$: CCT of the source |
| 2500 | 2460 ± 120 | 0.0000 | For $T_x < 2870K$; |
| 2700 | 2725 ± 145 | 0.0000 | 0.000 ± 0.0060 |
| 3000 | 3045 ± 175 | 0.0001 | For $T_x \geq 2870K$; |
| 3500 | 3465 ± 245 | 0.0005 | $D_{uv}(T_x) \pm 0.0060$ |
| 4000 | 3985 ± 275 | 0.0010 | where |
| 4500 | 4603 ± 243 | 0.0015 | $D_{uv}(T_X) = 57700 \cdot$ |
| 5000 | 5029 ± 283 | 0.0020 | $1/T_x - 44.6 \cdot$ |
| 5700 | 5667 ± 355 | 0.0025 | $1/T_x + 0.00854$ |
| 6500 | 6532 ± 510 | 0.0031 | |
| Flexible CCT (2200-6500) | $T_F \pm \Delta T$, where $T_F$ is chosen to be at 100K steps (2300K, 2400K, . . . , 6400K), excluding the 10 nominal CCT values listed; and $\Delta T = 1.1900 \cdot 10^{-8} \cdot T^3 - 1.5434 \cdot 10^{-4} \cdot T^2 + 0.7168 \cdot T - 902.55 = 1.1900$ x | $D_{uv}(T_F)$, same as the $D_{uv}$ tolerance range | |

With reference again to FIG. 4, a non-uniform-mapping curve 403 maps CCT values that are spaced uniformly based on a given user-control input. The user-control input relates to a desired CCT value. However, two equal intervals on the user control is not equivalent to an approximately equal difference in CCT space. That is, the non-uniform-mapping curve 403 is based on equal steps (e.g., from a first level of 16 units, to a second level of 32 units, to a third level of 48 units, to a fourth level of 64 units, etc., where the units are arbitrary but equal intervals) between adjacent points on the CCT-control device. However, the equal steps result in non-uniform increases in perceptual CCT values.

A uniform-mapping curve 401 maps selected CCT values to equally-spaced intervals on the user control. That is, the uniform-mapping curve 401 has non-equal steps (e.g., from a first level of 3 units, to a second level of 6 units, to a third level of 10 units, to a fourth level of 13 units, etc., where the units are arbitrary but unequal intervals) between adjacent points on the CCT-control device. However, the non-equal steps result in approximately uniform increases in perceptual CCT values.

A person of ordinary skill in the art will readily recognize in FIG. 4 that a large majority of the points of the uniform-mapping curve 401 is concentrated within approximately the first quarter of the curve (e.g., a control-input value of about 0 to about 340 units of the control-input value). As the control-input value is increased, a distance between subsequent points on the uniform-mapping curve 401 increases (a greater distance between subsequent points on the curve). Consequently, when an end-user changes the input control device (e.g., the CCT-control device of FIG. 3), the color temperature of an LED or LED array coupled to the input control changes rapidly at the lower portions of the control device and then the color temperature of the LED or LED array changes very slowly thereafter. This non-linear situation creates a jumpy experience for the end user where higher color temperatures especially become increasingly difficult to control accurately.

With the non-uniform-mapping curve 403, the end user is enabled with a smooth and visually pleasant, tuning experience. For example, as the end user moves a small distance at the beginning of, for example, a linear motion of for example, a slider comprising a modified version of the CCT-control device 303, the color temperature of the LED increases a given amount. As the end user moves approximately the same small distance toward the end of the linear motion of the slider, the perceptual color difference in the color temperature of the LED increases about the same given amount as at the beginning of the slider range.

In order to accomplish the smooth and visually pleasant tuning experience, a method to find appropriate slider increments and a modified version, in accordance with the disclosed subject matter, of the CCT-control device of FIG. 3 is described below. Consequently, consider that there are N points on a CCT tuning-curve between two given CCT values. As outlined below, the N points are calculated in such a way that the perceptual difference in color between the two adjacent points is substantially uniform.

Figure 5:
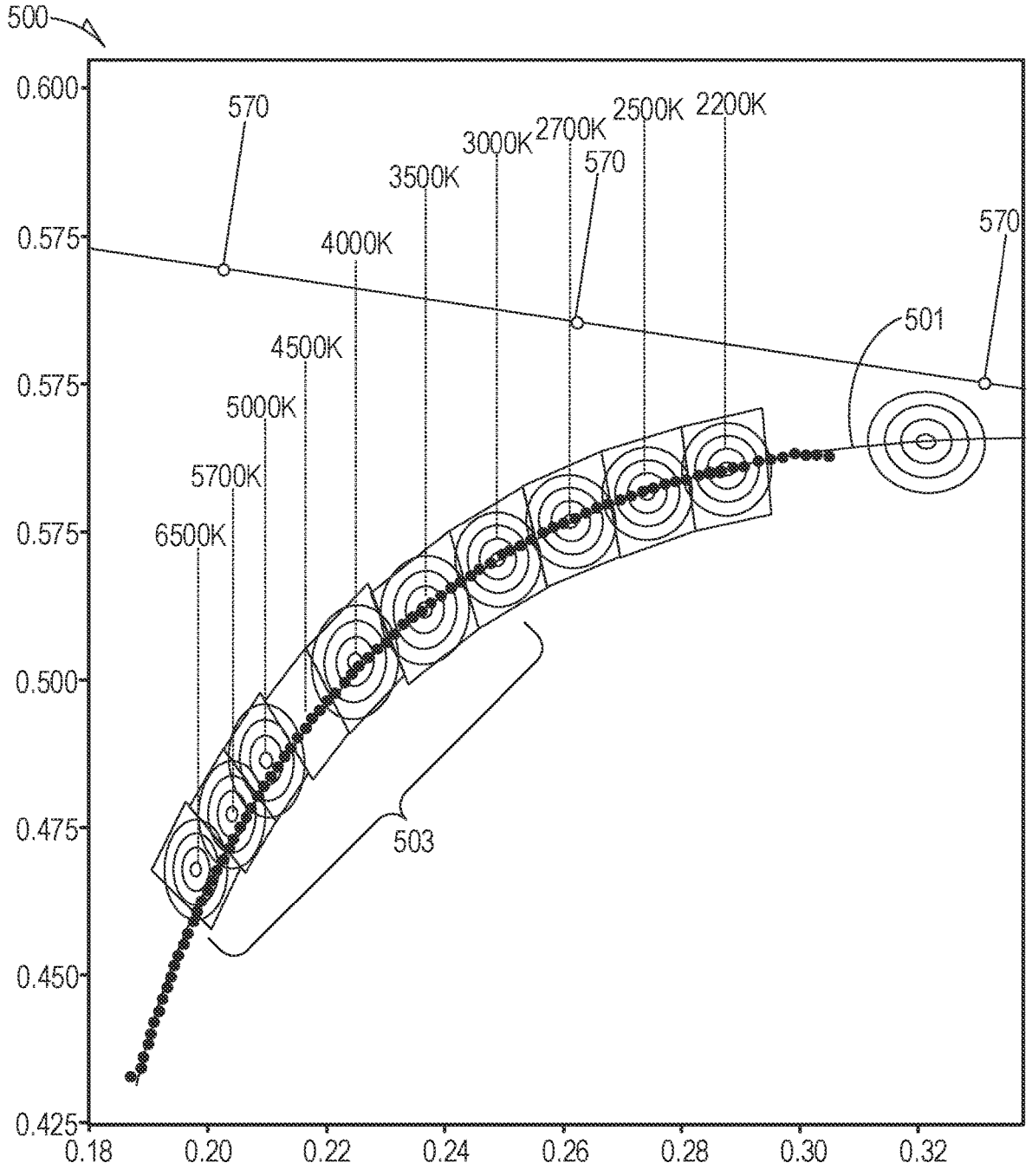
FIG. 5 shows an exemplary embodiment of a series of selected control-points along the BBL in accordance with various embodiments of the disclosed subject matter.

FIG. 5 shows an exemplary embodiment of a series of selected control-points 500 substantially along a BBL 501 in accordance with various embodiments of the disclosed subject matter. The selected control-points on the BBL 501 represent points of the CCT tuning-curve described above. For example, a portion 503 of the selected control-points shown are within a range of approximately 6500 K to about 3000 K. However, the selected control-points do not need to lie on the BBL 501. For example, in various embodiments, the selected control-points may lie close to the BBL, such as within a selected Macadam Ellipse (see FIG. 1) or over a selected range of Macadam Ellipses.

An end-user control interface, for example, a control device comprising, for example, a slider or a dial, then has a movement range linearly mapped to the calculated N points. In an embodiment, the linearly mapped movement-range is then stored (e.g., into a storage area, such as memory and/or programmed in software, hardware, or firmware) in a CCT-control device. In another embodiment, the linearly mapped movement-range may alternatively be stored (e.g., into a storage area, such as memory and/or programmed in software, hardware, or firmware) in, for example, a remote controller box or within an LED array. In both embodiments, the storage device is electrically coupled, either internally or externally, to the CCT-control device to correlate a mechanical movement of the CCT-control device to provide substantially uniform increases in perceptual CCT values from one or more LEDs or an LED array. In either case, the calculated N CCT-points can be generated, for example, in the CIE 1976 space. The CIE 1976 color space is considered a perceptually uniform color space. The same Euclidean distance in this space is considered perceptually uniform.

Figure 6:
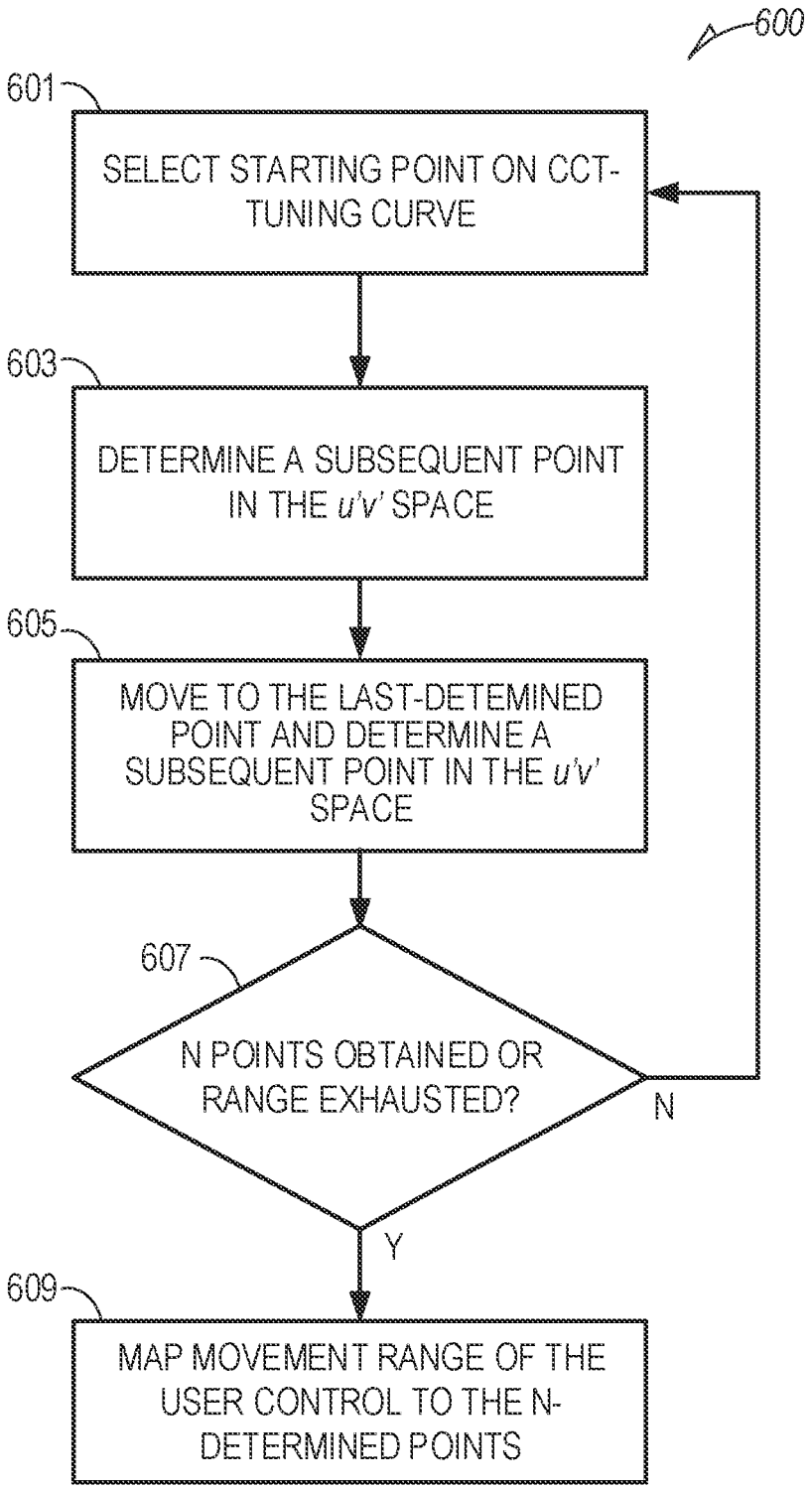
FIG. 6 shows an exemplary method process-flow diagram for making a determination of control-device points for a CCT tuning-curve.

With reference now to FIG. 6, an exemplary method process-flow diagram 600 for making a determination of control-device points for a CCT tuning-curve is shown. In an exemplary embodiment, the calculation begins at operation 601 by choosing a starting point (e.g., a color temperature on the BBL line) of the CCT tuning-curve. At operation 603, a subsequent point of the CCT tuning-curve is considered that is approximately equal to a desirable distance, d, in the u'v' space. At operation 605, the exemplary method moves to the last-determined point and another subsequent point is determined that is again approximately equal to a desirable distance, d, in the u'v' space. At operation 607, the exemplary method is repeated until either N points are obtained, or the tuning range is exhausted.

To find the point that is at a fixed distance (e.g., a desirable or predetermined distance), an interception point may be calculated analytically between the CCT tuning-curve and a circle of a radius, d, in the u'v' color space (see, e.g., FIG. 5). Alternatively, the CCT tuning-curve can be converted to u'v' coordinates with a sufficiently high resolution and then traverse all the points on the CCT tuning-curve.

All points matching or approximately matching the criteria, including the first one, are then put into a list as an output to be used in the user control (e.g., the CCT-control device). Consequently, after the N points are obtained, the movement range of the user control is linearly mapped to the N points at operation 609. For example, if the movement range of the user control is 256 discrete steps and the number of points, N, is 64, then each interval of 4 is assigned to a CCT value from the determined values of the N points.

In an exemplary embodiment, an algorithm used to make the CCT transitions linear or substantially linear includes, for example, starting from an initial point, determining the next point at the specified distance. When the next point at the specified distance is found, the algorithm advances to the point just found and then determining the next point at the specified distance. All points matching the criteria, including the first one, are then put into a list as the output.

The algorithm therefore generates points on the BBL as described above with reference to FIGS. 5 and 6. The same principle can be applied to other desirable types of curves as well. In one specific exemplary embodiment, an algorithm used to make the CCT transitions linear may be represented as follows:

```
def     getCCTbyUVprimeDist(start_CCT, end_CCT, uv_dist):
        cct_list = np.arange(start_CCT, end_CCT + 1) # get all the CCTvalues
            between the given range at a step size of 1
        cct_uvprime = getColorPointOnPlanckian(cct_list,colorSpace='uvprime') #
            get the u'v' coordinates of these CCT values
        selected_cct_list = [start_CCT] # start from the first CCTvalue
        total_cct_num = len(cct_list)
        first_cct = 0 # index of the first CCT
        second_cct = 0 # index of the next CCT
        while first_cct < total_cct_num - 1:
            found = False
```

-continued

```
        while second_cct < total_cct_num − 1:
            if distance (ColorPoint('uvprime', (cct_uvprime[first_cct, :])),
                    ColorPoint('uvprime', (cct_uvprime[second_cct,:]))) <
            uv_dist:
                second_cct += 1
            else:
                found = True
                selected_cct_list.append (cct_list[second_cct])
                first_cct = second_cct
                break
        if not found:
            break
    return selected_cct_list
```

A person of ordinary skill in the art, upon reading and understanding the disclosed subject matter, will recognize additional algorithms that may be employed to give the same or similar results. Additionally, the skilled artisan will recognize that similar types of algorithms may be coded in software, firmware, or implemented into various types of hardware devices such as an Application-Specific Integrated Circuit (ASIC) or dedicated processor or control device. Results from the algorithm (the output list described above) may then be added into the control device (e.g., added into a CCT-control device as saved as software within the control device to correlate a movement of the device to the desired CCT value, hard-coded into the control device to correlate a movement of the device to the desired CCT value, implemented into an ASIC within the control device to correlate a movement of the device to the desired CCT value, implemented into a processor or other type of hardware (e.g., a field-programmable gate array (FPGA) within the control device) to correlate a movement of the device to the desired CCT value, or by other means known in the art and described in more detail with reference to FIG. 7, below.

Machines with Instructions to Perform Various Operations

Figure 7:
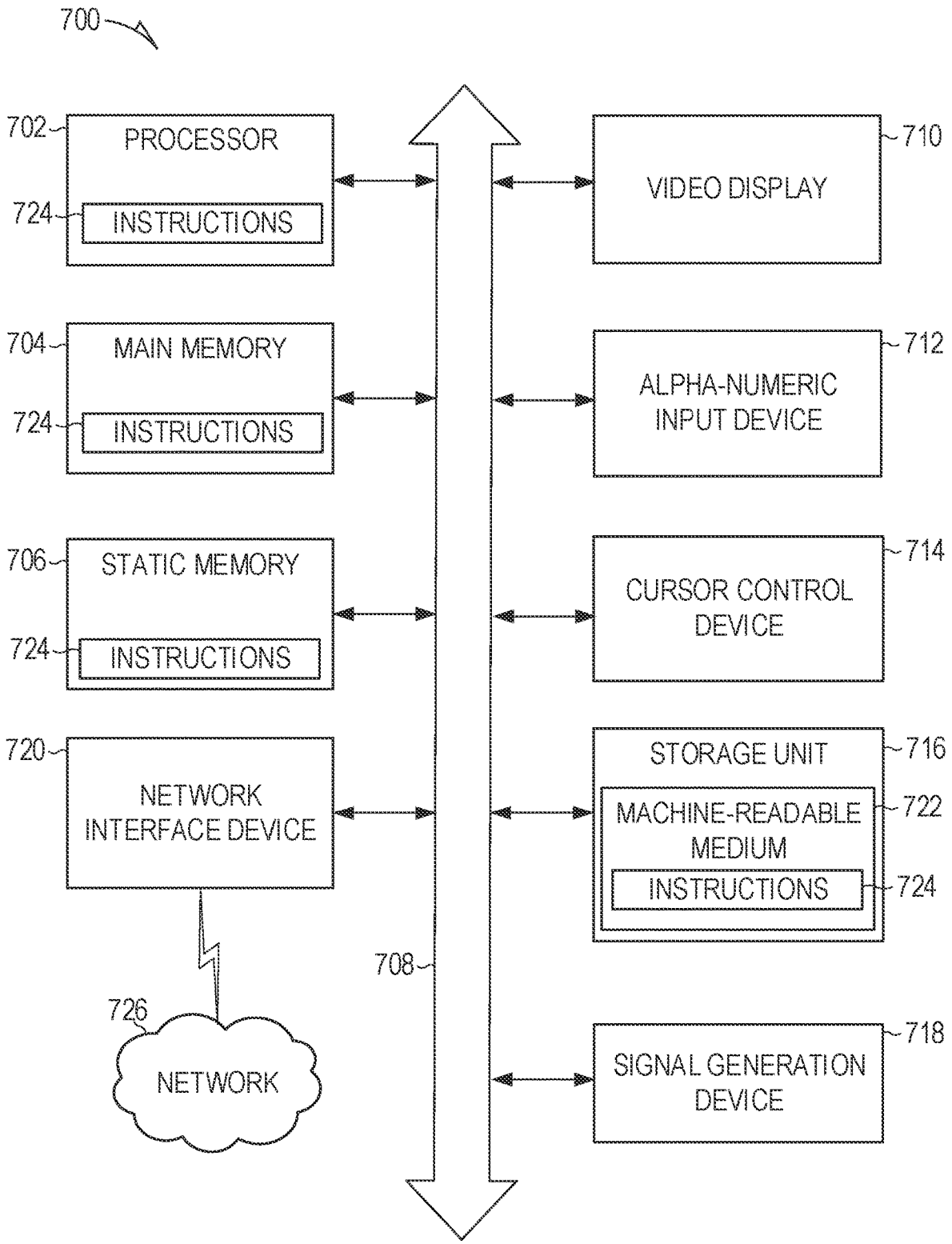
FIG. 7 shows a simplified block diagram of a machine in an example form of a computing system within which a set of instructions for causing the machine to perform any one or more of the methodologies and operations (e.g., CCT next-step determinations) discussed herein may be executed.

FIG. 7 is a block diagram illustrating components of a machine 700, according to some embodiments, able to read instructions from a machine-readable medium e.g., a non-transitory machine-readable medium, a machine-readable storage medium, a computer-readable storage medium, or any suitable combination thereof) and perform any one or more of the methodologies discussed herein. Specifically, FIG. 7 shows a diagrammatic representation of the machine 700 in the example form of a computer system and within which instructions 724 (e.g., software, a program, an application, an applet, an app, or other executable code) for causing the machine 700 to perform any one or more of the methodologies discussed herein (e.g., a process recipe) may be executed.

In alternative embodiments, the machine 700 operates as a standalone device or may be connected (e.g., networked) to other machines. In a networked deployment, the machine 700 may operate in the capacity of a server machine or a client machine in a server-client network environment, or as a peer machine in a peer-to-peer (or distributed) network environment. The machine 700 may be a server computer, a client computer, a personal computer (PC), a tablet computer, a laptop computer, a netbook, a set-top box (STB), a personal digital assistant (PDA), a cellular telephone, a smartphone, a web appliance, a network router, a network switch, a network bridge, or any machine capable of executing the instructions 724, sequentially or otherwise, that specify actions to be taken by that machine. Further, while only a single machine is illustrated, the term "machine" shall also be taken to include a collection of machines that individually or jointly execute the instructions 724 to perform any one or more of the methodologies discussed herein.

The machine 700 includes a processor 702 (e.g., a central processing unit (CPU), a graphics processing unit (GPU), a digital signal processor (DSP), an application specific integrated circuit (ASIC), a radio-frequency integrated circuit (RFIC), or any suitable combination thereof), a main memory 704, and a static memory 706, which are configured to communicate with each other via a bus 708. The processor 702 may contain microcircuits that are configurable, temporarily or permanently, by some or all of the instructions 724 such that the processor 702 is configurable to perform any one or more of the methodologies described herein, in whole or in part. For example, a set of one or more microcircuits of the processor 702 may be configurable to execute one or more modules (e.g., software modules) described herein.

The machine 700 may further include a graphics display 710 (e.g., a plasma display panel (PDP), a light emitting diode (LED) display, a liquid crystal display (LCD), a projector, or a cathode ray tube (CRT)). The machine 700 may also include an alpha-numeric input device 712 (e.g., a keyboard), a cursor control device 714 (e.g., a mouse, a touchpad, a trackball, a joystick, a motion sensor, or other pointing instrument), a storage unit 716, a signal generation device 718 (e.g., a speaker), and a network interface device 720.

The storage unit 716 includes a machine-readable medium 722 (e.g., a tangible and/or non-transitory machine-readable storage medium) on which is stored the instructions 724 embodying any one or more of the methodologies or functions described herein. The instructions 724 may also reside, completely or at least partially, within the main memory 704, within the processor 702 (e.g., within the processor's cache memory), or both, during execution thereof by the machine 700. Accordingly, the main memory 704 and the processor 702 may be considered as machine-readable media (e.g., tangible and/or non-transitory machine-readable media). The instructions 724 may be transmitted or received over a network 726 via the network interface device 720. For example, the network interface device 720 may communicate the instructions 724 using any one or more transfer protocols (e.g., hypertext transfer protocol (HTTP)).

In some embodiments, the machine 700 may be a portable computing device, such as a smart phone or tablet computer, and have one or more additional input components (e.g., sensors or gauges). Examples of such additional input components include an image input component (e.g., one or more cameras), an audio input component (e.g., a microphone), a direction input component (e.g., a compass), a location input component (e.g., a global positioning system (GPS) receiver), an orientation component (e.g., a gyroscope), a motion detection component (e.g., one or more accelerometers), an altitude detection component (e.g., an altimeter), and a gas detection component (e.g., a gas sensor). Inputs harvested by any one or more of these input components may be accessible and available for use by any of the modules described herein.

As used herein, the term "memory" refers to a machine-readable medium able to store data temporarily or permanently and may be taken to include, but not be limited to, random-access memory (RAM), read-only memory (ROM), buffer memory, flash memory, and cache memory. While the machine-readable medium 722 is shown in an embodiment to be a single medium, the term "machine-readable medium" should be taken to include a single medium or multiple media (e.g., a centralized or distributed database, or associated caches and servers) able to store instructions. The term "machine-readable medium" shall also be taken to include any medium, or combination of multiple media, that is capable of storing instructions for execution by a machine (e.g., the machine 700), such that the instructions, when executed by one or more processors of the machine (e.g., the processor 702), cause the machine to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" shall accordingly be taken to include, but not be limited to, one or more tangible (e.g., non-transitory) data repositories in the form of a solid-state memory, an optical medium, a magnetic medium, or any suitable combination thereof.

Furthermore, the machine-readable medium is non-transitory in that it does not embody a propagating signal. However, labeling the tangible machine-readable medium as "non-transitory" should not be construed to mean that the medium is incapable of movement—the medium should be considered as being transportable from one physical location to another. Additionally, since the machine-readable medium is tangible, the medium may be considered to be a machine-readable device.

The instructions 724 may further be transmitted or received over a network 726 (e.g., a communications network) using a transmission medium via the network interface device 720 and utilizing any one of a number of well-known transfer protocols (e.g., HTTP). Examples of communication networks include a local area network (LAN), a wide area network (WAN), the Internet, mobile telephone networks, POTS networks, and wireless data networks (e.g., WiFi and WiMAX networks). The term "transmission medium" shall be taken to include any intangible medium that is capable of storing, encoding, or carrying instructions for execution by the machine, and includes digital or analog communications signals or other intangible medium to facilitate communication of such software.

In some example embodiments, a hardware module may be implemented, for example, mechanically or electronically, or by any suitable combination thereof. For example, a hardware module may include dedicated circuitry or logic that is permanently configured to perform certain operations. A hardware module may be or include a special-purpose processor, such as a field-programmable gate array (FPGA) or an application specific integrated circuit (ASIC). A hardware module may also include programmable logic or circuitry that is temporarily configured by software to perform certain operations. As an example, a hardware module may include software encompassed within a central processing unit (CPU) or other programmable processor. It will be appreciated that a decision to implement a hardware module mechanically, electrically, in dedicated and permanently configured circuitry, or in temporarily configured circuitry (e.g., configured by software) may be driven by cost and time considerations.

In various embodiments, many of the components described may comprise one or more modules configured to implement the functions disclosed herein. In some embodiments, the modules may constitute software modules (e.g., code stored on or otherwise embodied in a machine-readable medium or in a transmission medium), hardware modules, or any suitable combination thereof. A "hardware module" is a tangible (e.g., non-transitory) physical component (e.g., a set of one or more microprocessors or other hardware-based devices) capable of performing certain operations and interpreting certain signals. The one or more modules may be configured or arranged in a certain physical manner. In various embodiments, one or more microprocessors or one or more hardware modules thereof may be configured by software (e.g., an application or portion thereof) as a hardware module that operates to perform operations described herein for that module.

In some example embodiments, a hardware module may be implemented, for example, mechanically or electronically, or by any suitable combination thereof. For example, a hardware module may include dedicated circuitry or logic that is permanently configured to perform certain operations. As noted above, a hardware module may comprise or include a special-purpose processor, such as an FPGA or an ASIC. A hardware module may also include programmable logic or circuitry that is temporarily configured by software to perform certain operations, such as the movement range that is linearly mapped to the calculated N points on the color-tuning device (e.g., see FIGS. 5 and 6).

The description above includes illustrative examples, devices, systems, and methods that embody the disclosed subject matter. In the description, for purposes of explanation, numerous specific details were set forth in order to provide an understanding of various embodiments of the disclosed subject matter. It will be evident, however, to those of ordinary skill in the art that various embodiments of the subject matter may be practiced without these specific details. Further, well-known structures, materials, and techniques have not been shown in detail, so as not to obscure the various illustrated embodiments.

As used herein, the term "or" may be construed in an inclusive or exclusive sense. Further, other embodiments will be understood by a person of ordinary skill in the art upon reading and understanding the disclosure provided. Further, upon reading and understanding the disclosure provided herein, the person of ordinary skill in the art will readily understand that various combinations of the techniques and examples provided herein may all be applied in various combinations.

Although various embodiments are discussed separately, these separate embodiments are not intended to be considered as independent techniques or designs. As indicated above, each of the various portions may be inter-related and each may be used separately or in combination with other types of electrical control-devices, such as dimmers and related devices. Consequently, although various embodiments of methods, operations, and processes have been described, these methods, operations, and processes may be used either separately or in various combinations.

Consequently, many modifications and variations can be made, as will be apparent to a person of ordinary skill in the art upon reading and understanding the disclosure provided herein. Functionally equivalent methods and devices within the scope of the disclosure, in addition to those enumerated herein, will be apparent to the skilled artisan from the foregoing descriptions. Portions and features of some embodiments may be included in, or substituted for, those of others. Such modifications and variations are intended to fall within a scope of the appended claims. Therefore, the present disclosure is to be limited only by the terms of the appended claims, along with the full scope of equivalents to which such claims are entitled. It is also to be understood that the terminology used herein is for the purpose of describing particular embodiments only and is not intended to be limiting.

The Abstract of the Disclosure is provided to allow the reader to quickly ascertain the nature of the technical disclosure. The abstract is submitted with the understanding that it will not be used to interpret or limit the claims. In addition, in the foregoing Detailed Description, it may be seen that various features may be grouped together in a single embodiment for the purpose of streamlining the disclosure. This method of disclosure is not to be interpreted as limiting the claims. Thus, the following claims are hereby incorporated into the Detailed Description, with each claim standing on its own as a separate embodiment.

What is claimed is:

1. An apparatus to color tune a light-emitting diode (LED) array for perceptually uniform color-tuning, the apparatus comprising:

a storage device electrically coupled to receive a signal from a CCT-control device, the storage device further configured to store and control a correlation between a mechanical movement range of the CCT-control device to provide substantially uniform increases in a plurality of perceptual CCT values from the LED array based on a set of N predetermined values, the set of N predetermined values being based on a number of discrete steps in the mechanical movement range of the CCT-control device and calculated such that a perceptual difference in color between two adjacent ones of the set of N predetermined values is to produce a perceptual difference in color to a human that is substantially uniform and linear relative to an incremental CCT increase, the storage device being further configured to map selected CCT values to substantially equally-spaced intervals on the CCT-control device to produce a substantially uniform-mapping curve having unequal step distances between adjacent ones of the N predetermined values.

2. The apparatus of claim 1, wherein the set of N predetermined values is determined as points on a CCT tuning-curve between two given CCT values, the set of N predetermined values are calculated such that a perceptual difference in color between two adjacent points is substantially uniform, wherein the unequal step distances are selected to reduce a non-uniform change in the perceptual CCT values as a level of the CCT-control device is changed.

3. The apparatus of claim 1, wherein the set of N predetermined values is determined to lie substantially along a black-body line (BBL).

4. The apparatus of claim 1, wherein the set of N predetermined values is determined to lie substantially near a black-body line (BBL).

5. The apparatus of claim 1, wherein the set of N predetermined values is determined to lie substantially near a black-body line (BBL) and within a selected Macadam Ellipse.

6. The apparatus of claim 1, wherein the set of N predetermined values is determined to lie substantially near a black-body line (BBL) and within a selected range of Macadam Ellipses.

7. The apparatus of claim 1, wherein the LED array includes at least one LED for each of three selected colors of light in a visible portion of the spectrum.

8. The apparatus of claim 1, wherein the LED array is a multi-colored array comprising a plurality of LEDs of different colors in a visible portion of the spectrum.

9. The apparatus of claim 8, wherein colors of LEDs in the LED multicolored array include at least one red LED, at least one green LED, and at least one blue LED.

10. The apparatus of claim 8, wherein the LED multicolored array comprises at least one desaturated red LED, at least one desaturated green LED, and at least one desaturated blue LED.

11. A controllable-lighting apparatus, comprising:

an LED array having at least one desaturated red LED, at least one desaturated green LED, and at least one desaturated blue LED; and a storage device electrically coupled to receive a signal from a CCT-control device, the storage device further configured to store and control a correlation between a mechanical movement range of the CCT-control device to provide substantially uniform increases in perceptual CCT values from the LED array based on a set of N predetermined values, the set of N predetermined values being calculated such that a perceptual difference in color between two adjacent ones of the set of N predetermined values is to produce a perceptual difference in color to a human that is substantially uniform and linear relative to an incremental CCT increase, the storage device being further configured to map selected CCT values to substantially equally-spaced intervals on the CCT-control device to produce a substantially uniform-mapping curve having unequal step distances between adjacent ones of the N predetermined values.

12. The controllable-lighting apparatus of claim 11, wherein the set of N predetermined values is determined as points on a CCT tuning-curve between two given CCT values, the set of N predetermined values are calculated such that a perceptual difference in color between two adjacent points is substantially uniform, wherein the unequal step distances are selected to reduce a non-uniform change in the perceptual CCT values as a level of the CCT-control device is changed.

13. The controllable-lighting apparatus of claim 11, wherein the LED array having the at least one desaturated red LED, the at least one desaturated green LED, and the at least one desaturated blue LED is configured to have a color temperature range of from about 2700 K to about 6500 K.

14. The control apparatus of claim 11, wherein the set of N predetermined values is determined to lie substantially along a black-body line (BBL).

15. The control apparatus of claim 11, wherein the set of N predetermined values is determined to lie substantially near a black-body line (BBL) and within a selected range of Macadam Ellipses.

16. A method for making a determination of control-device points for a correlated color temperature (CCT) tuning-curve, the method comprising:

determining a set of N predetermined values, the N predetermined values being calculated such that a perceptual difference in color between two adjacent ones of the N points produces a perceptual difference in color to a human that is substantially uniform and linear relative to an incremental CCT increase, the set of N predetermined values further being determined to map selected CCT values to substantially equally-spaced intervals on the CCT-control device to produce a substantially uniform-mapping curve having unequal step distances between adjacent ones of the N predetermined values.

17. The method for making a determination of control-device points for the CCT tuning-curve of claim 16, wherein a starting point for the CCT tuning-curve is selected to be on a black-body line (BBL).

18. The method for making a determination of control-device points for a CCT tuning-curve of claim 16, wherein a starting point is selected to be substantially near a black-body line (BBL) and within a selected Macadam Ellipse.

19. The method for making a determination of control-device points for a CCT tuning-curve of claim 16, further comprising repeating the determining steps until one or more stopping points is obtained that includes stopping points comprising obtaining the set of N predetermined values and exhausting a tuning range of a CCT-control device.

20. The method for making a determination of control-device points for a CCT tuning-curve of claim 16, further comprising making a determination of a point that is at a predetermined distance, d, in u'v' space from a selected starting point includes calculating analytically an interception point between the CCT tuning-curve and a circle of a radius, r, in a u'v' color space.

21. The method for making a determination of control-device points for a CCT tuning-curve of claim 20, wherein making a determination of the point that is at a predetermined distance, d, further comprises:

converting the CCT tuning-curve to u'v' coordinates; and subsequently traversing all the points on the CCT tuning-curve.

22. The method for making a determination of control-device points for a CCT tuning-curve of claim 20, further comprising storing all determined points, including a first selected starting point, into a list as an output to be used in a CCT-control device.

23. The method for making a determination of control-device points for a CCT tuning-curve of claim 22, further comprising linearly mapping a movement range of the CCT-control device to the all determined points.

* * * * *